US008960376B2

(12) United States Patent
De Coi

(10) Patent No.: US 8,960,376 B2
(45) Date of Patent: Feb. 24, 2015

(54) ELEVATOR CAR POSITION DETERMINATION AND DOOR OBSTRUCTION AVOIDANCE APPARATUS FOR AN ELEVATOR IN A THREE DIMENSIONAL STRUCTURE

(75) Inventor: Beat De Coi, Sargans (CH)

(73) Assignee: Cedes AG, Landquart (CH)

( * ) Notice: Subject to any disclaimer, the term of this patent is extended or adjusted under 35 U.S.C. 154(b) by 282 days.

(21) Appl. No.: 13/561,261

(22) Filed: Jul. 30, 2012

(65) Prior Publication Data

US 2013/0048434 A1 Feb. 28, 2013

Related U.S. Application Data

(60) Provisional application No. 61/526,390, filed on Aug. 23, 2011.

(30) Foreign Application Priority Data

Aug. 23, 2011 (EP) ..... 11006891

(51) Int. Cl.
*B66B 1/34* (2006.01)
*B66B 13/26* (2006.01)

(52) U.S. Cl.
CPC ..... *B66B 1/3492* (2013.01); *B66B 13/26* (2013.01)
USPC ..... 187/394; 187/247

(58) Field of Classification Search
CPC ..... B66B 1/3492; B66B 13/26
USPC ..... 187/247, 391–394
See application file for complete search history.

(56) References Cited

U.S. PATENT DOCUMENTS

| | | | | |
|---|---|---|---|---|
| 5,659,159 | A * | 8/1997 | Koopman, Jr. | 187/291 |
| 5,925,859 | A | 7/1999 | Miller et al. | |
| 6,435,315 | B1 * | 8/2002 | Zaharia | 187/394 |
| 7,077,244 | B2 * | 7/2006 | Oh et al. | 187/394 |
| 7,441,631 | B2 * | 10/2008 | Oh et al. | 187/394 |
| 7,493,991 | B2 * | 2/2009 | Oh et al. | 187/394 |
| 7,546,903 | B2 * | 6/2009 | Kattainen et al. | 187/316 |
| 7,571,791 | B2 * | 8/2009 | Finn et al. | 187/394 |
| 7,597,176 | B2 * | 10/2009 | Zaharia | 187/394 |
| 7,669,698 | B2 * | 3/2010 | Jahkonen | 187/394 |

(Continued)

FOREIGN PATENT DOCUMENTS

| | | |
|---|---|---|
| EP | 2 008 958 | 12/2008 |
| EP | 2 404 859 | 1/2012 |

(Continued)

OTHER PUBLICATIONS

Cedes: "Door closing protection with IMS 100," Cedes IMS 100 Installation and Operation Manual, Version 2.3. Mar. 24, 2011 (www.cedes.com/pdfs/produkte/el/106854multi_OperatingManual_IMS100.pdf).
European Search Report dated Jan. 20, 2012.

*Primary Examiner* — Anthony Salata
(74) *Attorney, Agent, or Firm* — Burr & Brown, PLLC

(57) ABSTRACT

An elevator apparatus including a position determination apparatus for determining the position of an elevator car inside an elevator shaft, the position determining apparatus including a marking unit for marking a position of the elevator car, and a detection unit for detecting the marking unit, the marking unit being arranged on one of the shaft doors and the detection unit being arranged on the associated car door or vice versa for the purpose of improved installation.

20 Claims, 4 Drawing Sheets

(56) References Cited

U.S. PATENT DOCUMENTS

| | | | | |
|---|---|---|---|---|
| 7,849,975 | B2 * | 12/2010 | Ketonen et al. | 187/394 |
| 8,115,162 | B2 * | 2/2012 | Shikai et al. | 250/221 |
| 2013/0284544 | A1 * | 10/2013 | De Coi et al. | 187/394 |

FOREIGN PATENT DOCUMENTS

| | | |
|---|---|---|
| JP | 2007-217136 | 8/2007 |
| WO | 2006/130145 | 12/2006 |

* cited by examiner

ELEVATOR CAR POSITION DETERMINATION AND DOOR OBSTRUCTION AVOIDANCE APPARATUS FOR AN ELEVATOR IN A THREE DIMENSIONAL STRUCTURE

CROSS REFERENCE TO RELATED APPLICATIONS

This application claims the benefit under 35 USC §119(a)-(d) of European Application No. 11 006 891.3 filed Aug. 23, 2011, and claims the benefit under 35 U.S.C. §119(e) of U.S. Provisional Application 61/526,390, filed Aug. 23, 2011, the entireties of which are incorporated herein by reference.

BACKGROUND OF THE INVENTION

1. Field of the Invention

The present invention relates to an elevator apparatus for conveying persons and/or items, a position determination apparatus, particularly for an elevator, an elevator door and a building.

2. Description of Related Art

Various position determination apparatuses for elevators are known in the prior art. So-called code bands which are continuously read by a sensor fitted to the elevator car are sometimes fitted inside the elevator shaft.

Reference is also made to the applicant's own applications EP 11 005 240 (U.S. Ser. No. 13/530,168) and EP 11 005 232 (U.S. Ser. No. 13/173,594).

SUMMARY OF THE INVENTION

The object of the present invention is to provide a position determination apparatus and an elevator apparatus which enable improved installation.

An elevator apparatus according to the present invention is distinguished by the fact that the corresponding marking unit is arranged on one of the shaft doors and the detection unit is arranged on the associated car door or, conversely, the marking unit is arranged on one of the car doors and the detection unit is arranged on the associated shaft door.

The elevator apparatus according to the present invention is used, in principle, to convey persons and items, the elevator or the car being guided inside an elevator shaft. The elevator shaft itself is in a three-dimensional structure comprising at least two floors, in particular in a building or the like. It is also conceivable for the three-dimensional structure to be, for example, a vehicle which comprises a plurality of floors, for example a ship. In principle, the three-dimensional structure may also be a type of framework. All possible three-dimensional structures in the sense of the invention in which an elevator can be used for conveyance between a plurality of floors are conceivable here.

The conveyance itself is effected in an elevator car which can accommodate the persons and/or items to be conveyed. The car in turn has a car door which can be opened and closed, in which case opening of the car door makes it possible to access the car, that is to say persons can get in or out or items can be put into the car or can be conveyed out of the car.

The elevator shaft has at least one shaft opening. Such shaft openings are generally arranged in the region or at the level of the individual floors. For example, it is conceivable for one shaft opening to be arranged per floor, but it is also possible, for example, to arrange two shaft openings on one floor, in particular on opposite sides of the car, with the result that the car can be accessed, for instance from two opposite sides.

Access in the sense of the present invention means that persons can get in or out of the car, for example, or corresponding items can be loaded into or unloaded from the car. In addition, at least one shaft door is arranged at the corresponding shaft opening. Such a shaft door closes the shaft opening, in particular even when there is currently no elevator car at the level of the shaft opening. This makes it possible to prevent persons from inadvertently being able to fall into the elevator shaft, inter alia.

If the elevator car stops at a particular floor on its journey through the elevator shaft, it accordingly stops at the level of a shaft opening which is associated with this floor. The elevator car then reaches a predetermined stopped position in the region of the shaft opening, this stopped position being selected in such a manner that it is possible to access the elevator shaft and thus the car. In principle, doors open and close only when the elevator car is in the stopped position; exceptions in emergency situations in which doors may possibly also be opened are conceivable.

The elevator car itself in turn has at least one car door for providing access to the elevator car. In the stopped position, a shaft door is respectively associated with the car door. The car door and the associated shaft door overlap at least partially with respect to the shaft opening and the car opening. The car door associated with a shaft door is generally arranged in such a manner that, for example in the closed state in the stopped position, persons who are in the car see the car door but do not see the associated shaft door which is then arranged behind the car door. Persons in turn who are outside the car on the corresponding floor usually only see the shaft door when it is closed during the stopped position of the car.

In order to make it possible to access the elevator shaft and the elevator car, the car and shaft doors must be opened. In addition, the shaft door and the associated car door generally move in the same direction.

The car door is movably mounted on the car, while the shaft door is movably mounted on the shaft itself, to be precise in the region of the shaft opening. A narrow gap, a gap opening, is also usually produced between the car door and the shaft door in the stopped position.

One shaft door may, in principle, be arranged at a shaft opening, but a plurality of shaft doors may also be provided. The elevator doors are usually accordingly fitted to the elevator car in a manner matching the door arrangement at the shaft openings. It is conceivable for two shaft doors to be arranged at the shaft opening, for example, where the two shaft doors each move in the opposite direction with respect to one another (sliding door) during opening and closing. Elevator doors which analogously correspond to the shaft opening doors, that is to say two elevator doors, for example, which move in the same manner as the (respectively associated) shaft doors during opening and closing, that is to say the shaft doors also move in the opposite direction with respect to one another, can likewise be provided in an associated elevator car. In this manner, a car door is accordingly associated with each shaft door.

An elevator apparatus according to the present invention also comprises a position determination apparatus for determining the position of the elevator car inside the elevator shaft. The position determination apparatus is thus used to determine an item of shaft or floor information. The position determination apparatus comprises a marking unit for marking the respective position and also a detection unit for at least one of detecting and reading the marking unit.

As a result of the measure whereby the marking unit is arranged on one of the shaft doors and the detection unit is arranged on the associated car door or vice versa, various advantages with regard to installation can be achieved in principle.

In particular, such an apparatus can be pre-installed. In commercially available elevator apparatuses, it is usually necessary for parts of the position determination apparatus or the entire position determination apparatus to be able to be installed only when the elevator car has been set up in the shaft because only in this manner is it possible to make the exact position information determinable with the aid of marking units in a referenced manner. This is because, if inaccuracies occur during construction or installation or the structure shifts in a non-uniform manner after a certain amount of time (that is to say "the structure settles"), as is frequently the case in buildings, the actual position no longer corresponds to the originally applied markings and the position determination apparatus generally operates inaccurately. However, it is particularly important for the shaft and car doors to respectively be able to assume a comparatively defined position with respect to one another in the stopped position. However, the shaft opening and the car can then be changed to a corresponding predetermined relative position with respect to one another if the reference for the corresponding positions is accurate enough. Such accurate adjustment is enabled when the marking unit and the detection unit are each in the corresponding sections which must be related to one another in terms of position detection.

Another advantage is that such an apparatus can also be retrofitted well. Costs can thus also be saved since lower costs overall have to be expended, in principle, for corresponding installation and comparatively simple replacement of the position determination apparatus is, however, additionally also possible.

The elevator apparatus according to the present invention also has the advantage that the sensors can be additionally protected. Since detection units, that is to say sensors, which are generally used in such elevator systems are exposed to very high loads on a construction site, the sensors can sometimes be damaged. The risk of the sensor being affected is present, in particular, when sensitive sensors are used. Finally, it is often also necessary for such sensors to be installed by special experts, for example, sensor engineers or electronics engineers. Therefore, it is particularly advantageous if the corresponding detection units and sensors can be pre-installed and can be installed when manufacturing the elevator, for example, in the factory itself. On the one hand, this measure also makes it possible to save costs since no experts have to be specifically called to the construction site in order to install the sensors and, on the other hand, installation at the factory can then be carried out under less adverse circumstances than would possibly be the case on the construction site.

Furthermore, it is usually advantageous for the detection unit and the marking unit to be arranged on mutually facing sides of the car door and the associated shaft door, respectively. This makes it possible for the detection unit and the marking unit to be held without an obstacle between them. This measure also accordingly makes it easier to read the marking unit. For the rest, in this embodiment, neither the detection unit nor the marking unit is generally visible to the user of the elevator because the mutually facing sides of the car door and the associated shaft door are precisely on the side facing away from the respective user. Although, for example, the side on which the marking unit or the detection unit is fitted to the shaft door faces a person in the car, this side is in turn concealed for the user in the car by the associated car door. Only the narrow gap opening between the mutually associated cars and shaft doors then generally lies between the detection unit and the marking unit. Detection is therefore advantageously effected only over a short distance and can consequently also be effected with the corresponding degree of precision.

For the rest, an exemplary embodiment of the present invention comprises a control unit for controlling the journey of the elevator car. In the present sense, the term "control" means at least one of open-loop control and closed-loop control. The control unit can then preferably be designed in such a manner that the shaft door and the associated car door can be moved in a substantially synchronous manner when opening and/or closing the shaft door and the car door. However, it is not absolutely necessary for this to take place in an absolutely synchronous manner. The position determination apparatus is preferably connected to a control unit or electronic unit, with the result that the journey of the car to the corresponding floor is subjected to open-loop/closed-loop control according to the floor selected by the user, the floor information being determined by the position determination apparatus.

In principle, it is conceivable for the shaft door and/or the car door to be in the form of solid doors from a solid body. However, this is usually not required, on the one hand, and is usually even undesirable, on the other hand, since such solid doors have a high weight and are also considerably more cost-intensive. Solid doors are also usually more difficult to install and transport. For example, a shaft or car door may only consist only of walls, for example may be produced from sheet metal such as sheet steel.

In one preferred embodiment of the present invention, a recess and/or indentation may be provided in shaft doors and/or associated car doors on mutually facing sides, which recess and/or indentation uncover(s) an intermediate space between the shaft door and the associated car door. Such a recess/indentation may be formed in a wide variety of ways.

In the case of a door formed from walls (that is to say not from solid material), the walls may be formed, for example, in such a manner that they do not completely delimit or surround the door to the outside. An opening, a recess, is present to some extent in associated shaft or car doors on the mutually facing sides thereof. However, it is also possible for the wall not to be interrupted on the respective facing sides but rather to be deformed away from the respectively associated door. For example, the car door is accordingly provided with a deformation, an indentation, in the direction of the car, while the shaft door could be provided with a protrusion away from the car, for example. In addition to the gap openings which are present anyway between associated shaft and car doors, this produces a further space which is thus uncovered, that is to say a larger intermediate space between the two associated doors.

However, such recesses can also be provided when shaft doors and car doors are solid. Such a recess may, in principle, also be removed from the solid material. It is also conceivable for such recesses to be provided either only on one car door or only on one shaft door, only on a few shaft doors or only on some car doors or else on all shaft doors or all car doors.

In order to be able to provide a particularly space-saving marking unit, the latter may be in the form of adhesive tape in one embodiment variant of the present invention. This also usually means simple production of such a marking unit and installation which is also simple. Additional markers which indicate where the marking unit in the form of adhesive tape must be affixed may also have already been applied to the corresponding doors. This measure possibly facilitates installation. Particularly when there is only one gap opening between the car and the shaft doors, it is advantageous to provide a correspondingly thin marking unit, such that no collisions and no wear can result. The design in the form of adhesive tape makes it possible to implement the marking unit in a particularly simple manner. It is also conceivable to provide the marking unit in the form of a plate.

In one embodiment of the present invention, the marking unit is also in the form of a carrier of a 2D code. It is also conceivable to also use a simple one-dimensional barcode. However, a 2D code also has the advantage that greater coding/information density becomes possible. The 2D code may be composed of different segments in which different information is coded. In particular, the segments may contain position information or floor information. In addition, the marking unit can be easily produced in an advantageous manner since a 2D code can be easily printed on, for example, onto an adhesive tape. Consequently, the marking unit can be very thin, that is to say can be designed and arranged in a space-saving manner.

Particularly when the marking unit is in the form of a barcode or a 2D code, it is advantageous for the detection unit to be in the form of an optical sensor. In the meantime, optical sensors can be produced in a comparatively cost-effective manner. They make it possible to precisely and reliably detect and read marking units. In addition, optical sensors can also operate in a correspondingly rapid manner and can also be evaluated in a particularly rapid manner, such that a result in terms of the position information can be present in the control unit within a very short time.

If a recess is also provided in shaft and car doors, this measure enables not just a simplified structure and corresponding advantages with regard to the shaft and car doors themselves. In addition, the additional space which is gained and is provided by the intermediate space can be used to accommodate further apparatuses or structural units of the elevator. For this reason, it is advantageous, in one embodiment of the present invention, to arrange the marking unit and/or the detection unit in the intermediate space formed by the recess. This makes it possible to avoid the thickness of the corresponding doors also being increased by fitting the marking unit and/or detection unit or makes it possible for the thickness of the doors to be increased only negligibly. Even when it is narrow and compact, the detection unit will usually have at least a certain thickness and will possibly also be thicker than an existing gap opening between the car door and the associated shaft door even if any recesses or indentations were not present. In any case, the space gained by the recess/indentation or by the intermediate space can be used for this purpose.

However, such elevator systems generally do not just require a sensor system for position determination. In the case of elevators, the objective is usually to prevent persons from being caught or squashed in the access region of the elevator car. If, for example, a person reaches into the still open gap of a closing door, it is necessary to stop the movement of the door as quickly as possible and possibly for the door to also open again. It is particularly advantageous if the corresponding detection unit additionally comprises a further optical sensor for detecting persons and/or items.

In one exemplary embodiment of the present invention, such a further optical sensor for detecting persons and/or items may be in the form of a light barrier sensor for emitting and/or receiving light barrier signals. Such a light barrier may likewise be implemented in various ways.

For example, a transmitting unit which emits optical signals may be provided in the detection unit. A reflection element, for example a metal lug with which the optical signal is reflected and passes to a receiving unit in the detection unit again, can then be fitted at a predefined location, for example. If this signal is detected, this means that there is no person/no item in the light barrier. Otherwise, that is to say if a person and/or an item enter(s) the light barrier, the latter is interrupted and the optical signal does not pass back to the receiving unit or the detection unit again. In this case, a corresponding signal is transmitted to the control unit and causes a movement of doors (shaft doors and/or car doors) to be stopped or not to begin at all in the first place and causes the doors to possibly also open again. For better reflection, reflective stickers or labels may be applied to the corresponding reflection units, for example.

It is conceivable, for example, for the reflection unit to be arranged on the elevator car and/or on the car door, preferably in the intermediate space formed by the recess, and/or on the shaft door, preferably in the intermediate space formed by the recess. The detection unit may thus be arranged/designed in such a manner that it emits optical signals which are oriented parallel to the access opening and run through the gap opening. In particular, it is conceivable for the detection unit or at least one part of the detection unit to project into the gap opening in such a manner that a corresponding optical signal for detecting persons and/or items inside the gap opening is passed from there. That is to say, if the region inside the gap opening is monitored, precisely that region which is critical for monitoring is sensed thereby.

In principle, the entire door region can be sensed, for example, in the form of a grid. In this case, monitoring must generally be carried out, in spatial terms, at certain intervals with the result that it is possible to at least detect items starting from a certain size. In principle, it is also conceivable for the monitoring beams to be emitted in a radial manner.

Instead of or in addition to a light barrier, such an optical sensor for detecting persons and/or items may also be in the form of a so-called time-of-flight sensor (abbreviation: TOF sensor). In the case of such a sensor, the propagation time of an emitted signal, which is in turn at least partially reflected and passes to the detection unit again, is measured. Such signals may be effected, for example, using infrared light but, in principle, also with visible light (wavelength range of visible light: approximately 400 nm-800 nm). In this case, a special signal which changes only very slowly with respect to the oscillation duration of the light, that is to say a (very) low-frequency signal in comparison for example, can be modulated onto the corresponding emitted optical signal, for example. With a low-frequency signal which has been modulated on, the phase shift with respect to the emitted signal can then be determined after detecting a reflected portion. It is thus possible to determine the propagation time. If items or persons now enter the region being monitored, the propagation distance is shortened and the propagation time of the emitted signal is thus also shortened.

A position determination apparatus according to the present invention is accordingly designed to determine the position of an elevator car inside the elevator shaft for at least one of an elevator apparatus according to the present invention and an exemplary embodiment of the elevator apparatus according to the present invention and is distinguished, in particular, by the fact that the marking unit can be fitted to one of the shaft doors and the detection unit can be fitted to the associated car door or vice versa. An elevator door according to the present invention, that is to say a shaft door or a car door in particular, is distinguished by the fact that an embodiment of a position determination apparatus according to the present invention is provided.

A building according to the present invention is also distinguished by the fact that one of an elevator apparatus according to the present invention or an embodiment variant of the elevator apparatus according to the present invention is present.

BRIEF DESCRIPTION OF THE DRAWINGS

Exemplary embodiments of the present invention are illustrated in the drawings and are explained in more detail below while stating further advantages and details.

DETAILED DESCRIPTION OF THE INVENTION

Figure 1:
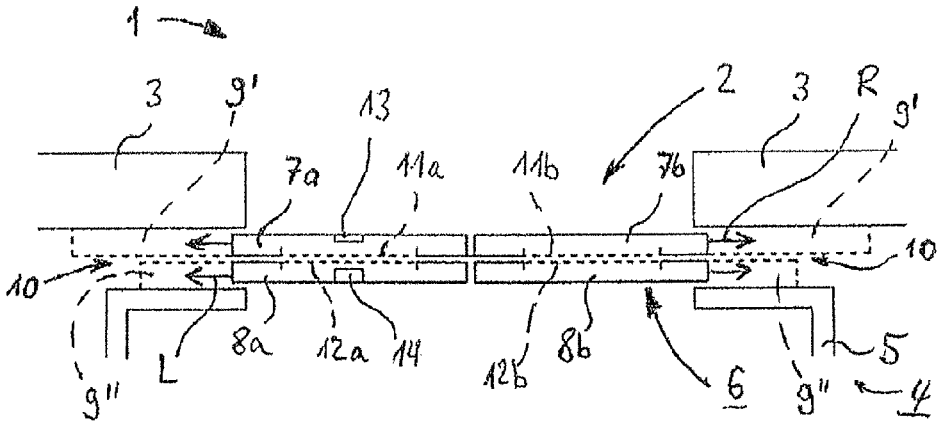
FIG. 1 shows a diagrammatic illustration of an elevator apparatus having sliding doors according to the present invention.

FIG. 1 shows a diagrammatic section through part of an elevator apparatus 1 in plan view in the region of a shaft opening 2. The concrete walls 3 with the shaft opening 2 (already mentioned) between them and a shaft 4, in which an elevator car 5 is in turn located and can be moved, are illustrated inter alia. The direction of movement runs perpendicular to the plane of the drawing in FIG. 1. A sliding door system 6 which makes it possible to access the elevator car 5 through the shaft opening 2 is also provided. This sliding door system 6 in turn comprises two shaft doors 7*a* and 7*b*. These shaft doors 7*a* and 7*b* belong to the shaft and are fastened or movably mounted in the region of the shaft opening 2. The car doors 8*a* and 8*b* are in turn movably mounted on the car 5 itself. The shaft door 7*a* is associated with the car door 8*a*, while the shaft door 7*b* is associated with the car door 8*b*.

During opening of the sliding door 6, the doors associated with one another, that is to say the shaft door 7*a* and the car door 8*a*, move to the left in the drawing (cf. direction arrows L), while the shaft door 7*b* and the car door 8*b* move to the right (cf. direction arrows R). This movement is effected synchronously. A person who is inside the car 5, for example, therefore only sees the car doors 8*a* and 8*b* when the sliding door 6 is closed, whereas a person who is on the floor on the other side of the sliding door 6 (that is to say at the top in the drawing) sees only the shaft doors 7*a* and 7*b*. During opening, the doors each move simultaneously to the left (namely the doors 7*a* and 8*a*) and to the right (the doors 7*b* and 8*b*). The reference symbol 9' denotes the rolling plane in which the shaft doors 7*a* and 7*b* move, while the reference symbol 9" denotes the rolling plane of the car doors (8*a* and 8*b*). These rolling planes 9' and 9" are each illustrated using dashed lines in the drawing. A gap opening 10 is situated between these rolling planes 9' and 9" and thus correspondingly also respectively runs between the car doors 8*a*, 8*b*, on the one hand, and the shaft doors 7*a*, 7*b*, on the other hand.

The shaft opening doors 7*a*, 7*b* and also the car doors 8*a*, 8*b* each have associated recesses 11*a*, 11*b* and 12*a*, 12*b*. These recesses 11*a*, 11*b*, 12*a*, 12*b* are in the form of openings inside the door sides which are respectively associated with one another. A code band 13 in the form of adhesive tape is arranged in the recess 11*a* in the shaft door 7*a*. An optical sensor in the form of a detection unit 14 is arranged on the inside of the associated car door 8*a* exactly opposite the shaft door 7*a* and the code band 13 in the stopped position. The optical sensor 14 has a greater thickness than the adhesive tape 13 but may be integrated in the door 8*a* by means of the recess 12*a* in such a manner that it does not project into the gap opening 10.

During the journey of the car elevator 5, all doors 7*a*, 7*b*, 8*a*, 8*b* are closed. When the elevator car 5 moves past the shaft opening 2, the optical sensor 14 can read the code band 13 and can thus determine the position of the elevator car 5. In particular, this makes it possible to provide a relatively accurate reference with respect to the shaft opening 2 and thus makes it possible to obtain an accurate item of position information.

Figure 2:
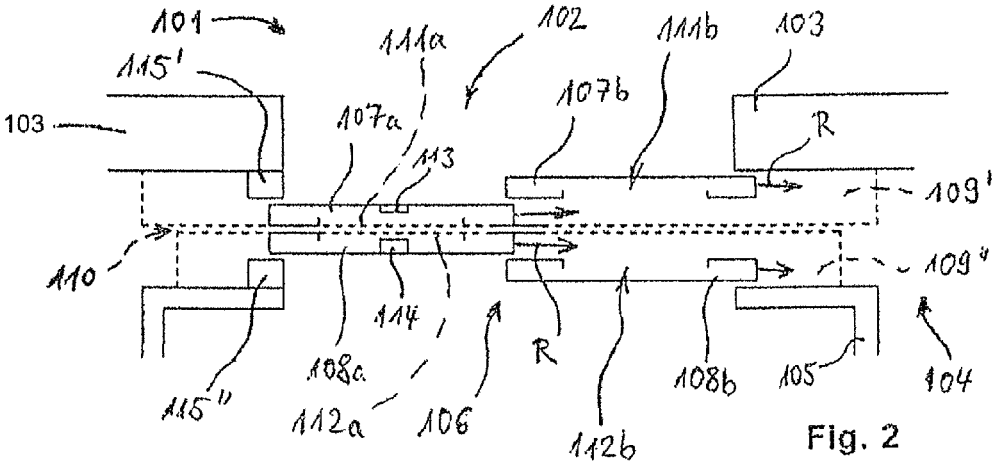
FIG. 2 shows a diagrammatic illustration of an elevator apparatus according to the present invention having a telescopic sliding door.

FIG. 2 in turn illustrates a similar situation, namely an elevator apparatus 101 with a shaft opening 102, concrete walls 103, a shaft 104 and a car 105 which moves in the shaft. However, in contrast to FIG. 1, the sliding door 106 is in the form of a telescopic sliding door. In this case, the shaft door 107*a* is arranged such that it is offset with respect to the shaft door 107*b* perpendicular to the displacement direction. The car doors 108*a* and 108*b* are likewise accordingly offset with respect to one another. Consequently, the associated doors, namely the shaft door 107*a* and the car door 108*a*, are closer to one another than the shaft door 107*b* and the shaft door 108*b*. Overall, the rolling planes 109' and 109" are broader since the shaft doors 107*a*, 107*b* have to be accommodated beside one another in the open position (similarly the car doors 108*a* and 108*b*). There is a gap opening 110 between the rolling planes 109' and 109" which are illustrated using dashed lines. However, all doors 107*a*, 107*b*, 108*a*, 108*b* can only travel to the right (direction of travel R) in the drawing. The control unit is designed such that the speed of travel of the doors 107*a* and 108*a* is faster than that of the doors 107*b* and 108*b*, such that both reach their end position during opening approximately equally quickly (similarly in the closing operation). The doors 107*a*, 107*b*, 108*a*, 108*b* also each have corresponding recesses 111*a*, 111*b*, 112*a*, 112*b*, in which case the code band 113 and the optical sensor 114 are each correspondingly arranged in the doors 107*a* and 108*a*. The side stop on the shaft 115' and the side stop on the car 115", which are respectively fitted to a concrete wall 103 and, in the case of reference symbol 115", to the car 105, are used to prevent a person from being able to laterally intervene and thus being squashed, in particular, while the car 105 is moving.

Figure 3:
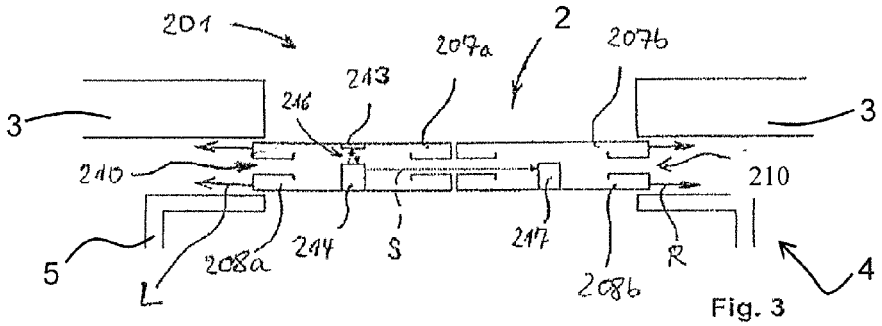
FIG. 3 shows a diagrammatic illustration of an elevator apparatus having a sliding door and a light barrier according to the present invention.
Figure 4:
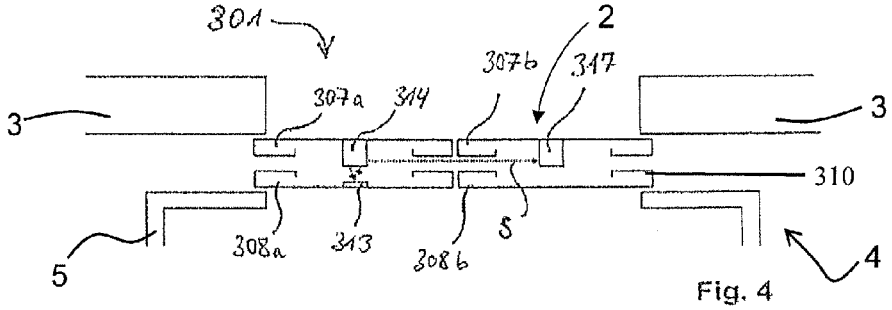
FIG. 4 shows a diagrammatic illustration of a further elevator apparatus having a sliding door and a light barrier according to the present invention.
Figure 5:
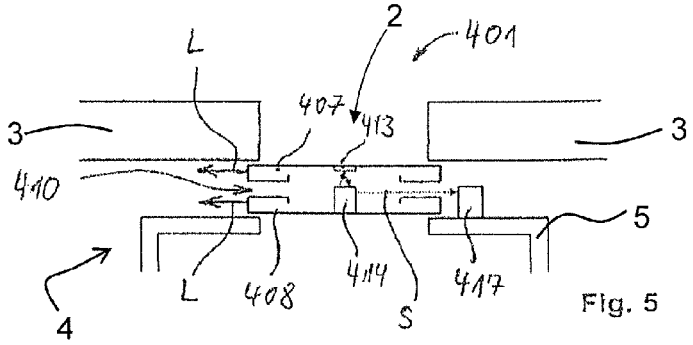
FIG. 5 shows a diagrammatic illustration of an elevator apparatus having a single door and an additional light barrier according to the present invention.

FIG. 3 shows a similar elevator apparatus 201 to that illustrated in FIG. 1. In FIGS. 3-5, elements common to these Figs. And FIG. 1 are illustrated in accordance with the reference numbers in FIG. 1 and are not discussed with respect to FIGS. 3-5. In the present case, a code band 213 is likewise arranged in the shaft door 207*a*, while a detection unit 214 is provided in the car door 208*a*. The arrows 216 illustrate how the detection unit 214 reads the code band 213. A gap 210 is provided between the shaft doors 207*a*, 207*b* and the car doors 208*a*, 208*b*. However, the detection unit 214 projects light beams into this gap opening. The detection unit 214 also comprises an optical sensor for detecting persons and/or items. This optical sensor which is integrated in the detection unit 214 emits light beams parallel to the direction of movement of the sliding doors, to be precise to the right along the arrow S in the drawing. A light barrier detector 217, for example, in the form of an optical detector, is situated to receive the light emitted by the optical sensor integrated in the detection unit 214 to form a light barrier. It is also conceivable for a reflection lug which reflects the optical signal emitted by the optical sensor integrated in the detection unit 214 again to be arranged at the same location instead of the light barrier detector 217. If the doors 207*b*, 208*b*, and 207*a*, 208*a* accordingly open to the right and to the left (displacement directions R and L), respectively, an ever larger gap through which the light beams from the optical sensor integrated in the detection unit 214 forming the light barrier pass forms perpendicular to the gap opening 210 in the region between the mutually associated doors 207*a* and 208*a* and 207*b* and 208*b*.

FIG. 4 shows a similar elevator apparatus 301 to that in FIG. 3, but the code band 313, which is in the form on an adhesive tape, is arranged on the car door 308*a*, the corresponding detection unit 314 is arranged on the shaft door 307*a* and the light barrier detector 317 is accordingly arranged on the shaft door 307*b*. The light barrier has the light beam S, which pass through the gap opening 310 and in which case a movement of the doors is prevented/stopped if S is interrupted.

FIG. 5 in turn illustrates an elevator apparatus 401 (similar to that in FIG. 3) in which only one shaft door 407 and only one car door 408 are provided. The light barrier has a light barrier detector 417. In contrast to FIG. 3, however, the light barrier detector 417 is fastened to the rigid housing of the car 405 and not to a movable door. The two doors 407*a* and 408*a* can only be moved to the left (direction arrow L). The detection unit 414, which is in the form of an optical sensor system that can be used to read the code band 413 and also emits the optical signal S for the light barrier that projects into the gap opening 410 in this case. The light barrier detector 417 accordingly projects to the same extent in an extension of the gap opening 410.

Figure 6:
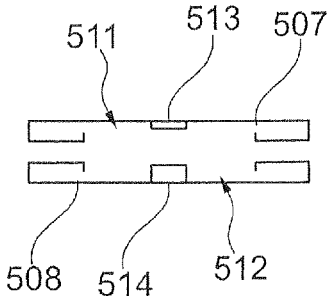
FIG. 6 shows a diagrammatic illustration of an associated shaft door and car door with recesses and with a marking and detection unit according to the present invention.

FIG. 6 shows a shaft door 507 and an associated car door 508 with a code band 513 on the shaft door 507 and a detection unit 514, which is in the form of a sensor on the car door 508, both doors each having recesses 511, 512 in the sense of openings.

Figure 7:
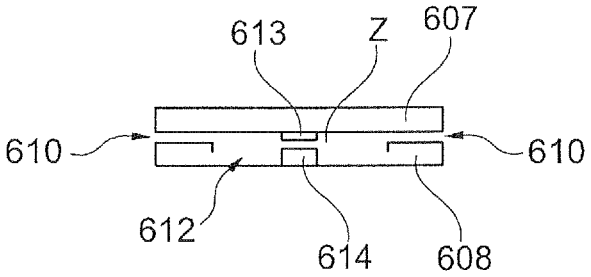
FIG. 7 shows a diagrammatic illustration of the shaft door and car door according to the present invention with a total of only one recess.

FIG. 7 in turn shows a configuration in which the shaft door 607 has a closed peripheral wall, while the car door 608 has a recess 612 in the sense of an opening. The detection unit 614 is arranged in the recess 612. There are a gap opening 610 and an intermediate space Z between the two doors. The code band is affixed to or on the shaft door 607.

Figure 8:
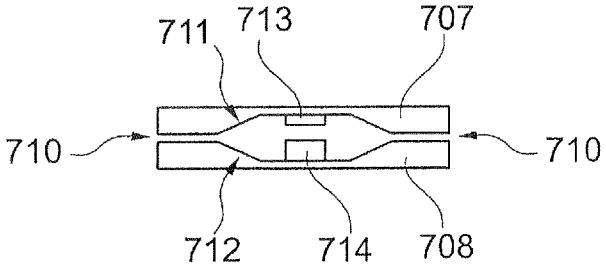
FIG. 8 shows a diagrammatic illustration of the associated shaft door and car door with indentations according to the present invention.

In FIG. 8, the shaft door 707 and the car door 708 are in turn designed such that indentations 711 and 712 increase the size of the gap opening 710 in the corresponding region. The code band 713 and the detection unit 714, which is in the form of an optical sensor, for example, are respectively arranged in the indentations 711 and 712.

Figure 9:
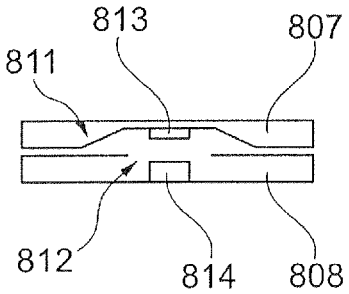
FIG. 9 shows a diagrammatic illustration of the shaft door and car door with a recess and an indentation according to the present invention.

The double door illustrated in FIG. 9 comprises a shaft door 807 and a car door 808 with code band 813 and optical sensor 814, an indentation 811 being formed in the shaft door 807 and a recess 812 being formed in the car door 808.

Figure 10:
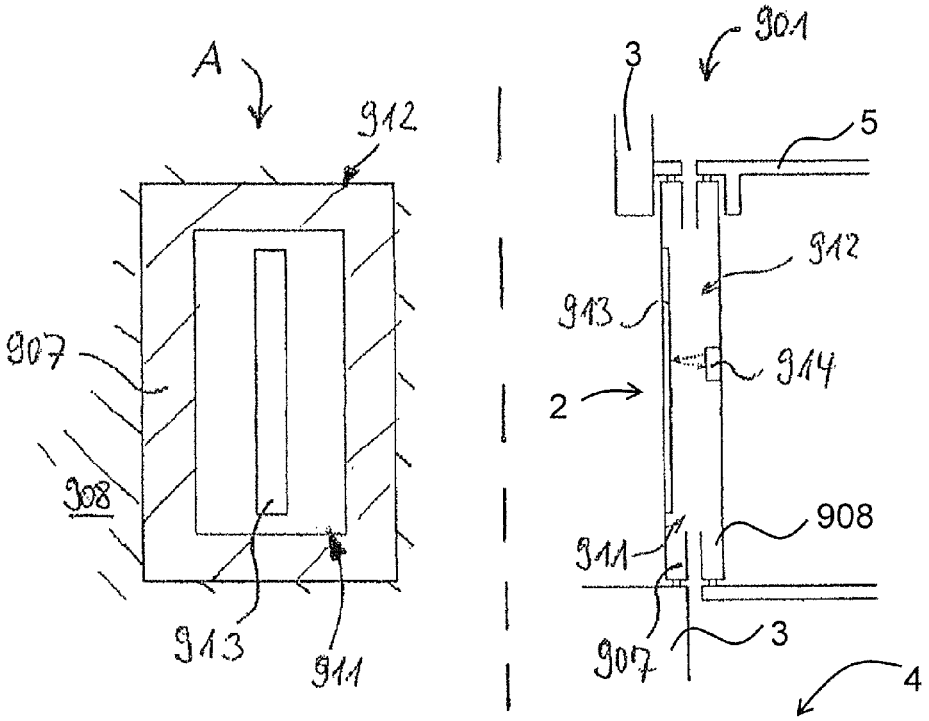
FIG. 10 shows a diagrammatic illustration of how the code band is detected by the detection unit, in two views.

FIG. 10 likewise shows an elevator apparatus 901 according to the present invention and a corresponding view A which outlines how the code band 913 is perceived from the point of view of the detection unit 914. In this case, the detection unit 914 detects an image through the recesses (i.e., openings) 911, 912 in the shaft and car doors 907, 908, respectively, through which the code band 913 becomes visible through the gap (not described in any more detail here) between the associated doors. An edge of the car door 908 is consequently still visible on the outside in the view A, then, through the opening 912, a view of the shaft door 907 with the opening 911 which in turn uncovers the view of the code band 913.

In principle, in one preferred embodiment of the invention, the marking unit is arranged on a shaft door and the detection unit is arranged on the associated car door. This embodiment can also generally be produced and installed in a more cost-effective manner.

LIST OF REFERENCE SYMBOLS

1 Elevator apparatus
2 Shaft opening
3 Concrete wall
4 Shaft
5 Elevator Car
6 Sliding door (as a whole)
7*a* Shaft door
7*b* Shaft door
8*a* Car door
8*b* Car door
9' Rolling plane of the shaft doors
9" Rolling plane of the car doors
10 Gap opening
11*a* Recess
11*b* Recess
12*a* Recess
12*b* Recess
13 Code band
14 Detection Sensor
101 Elevator apparatus
102 Shaft opening
103 Concrete wall
104 Shaft
105 Car
106 Sliding door (as a whole)
107*a* Shaft door
107*b* Shaft door
108*a* Car door
108*b* Car door
109' Rolling plane of the shaft doors
109" Rolling plane of the car doors
10 Gap opening
111*a* Recess
111*b* Recess
112*a* Recess
112*b* Recess
113 Code band
114 Optical sensor
115' Side stop on the shaft
115" Side stop on car
201 Elevator apparatus
207*a* Shaft door
207*b* Shaft door
208*a* Car door
208*b* Car door
210 Gap opening

213 Code band
214 Detection unit
216 Light
217 Light barrier detector
301 Elevator apparatus
307*a* Shaft door
307*b* Shaft door
308*a* Car door
308*b* Car door
310 Gap Opening
313 Code band
314 Detection unit
317 Light barrier detector
401 Elevator apparatus
407 Shaft door
408 Car door
410 Gap opening
413 Code band
414 Detection Unit
417 Light barrier detector
507 Car door
508 Shaft door
511 Recess
512 Recess
513 Code band
514 Detection Unit
607 Car door
608 Shaft door
610 Gap opening
612 Recess
613 Code band
614 Detection Unit
707 Car door
708 Shaft door
710 Gap opening
711 Indentation
712 Indentation
713 Code band
714 Detection unit
807 Car door
808 Shaft door
811 Indentation
812 Recess
813 Code band
814 Optical sensor
901 Elevator apparatus
907 Car door
908 Shaft door
911 Recess
912 Recess
913 Code band
914 Detector unit
A View
L Direction to the left
R Direction to the right
S Light barrier signal
Z Intermediate space

The invention claimed is:

1. An elevator apparatus for conveying at least one of people and items inside an elevator shaft of a three-dimensional structure having at least two floors, said elevator apparatus comprising:

an elevator car for accommodating the at least one of people and items to be conveyed, having at least one car door for at least one of opening and closing the elevator car;

an elevator shaft having at least one shaft opening for accessing at least one of the elevator shaft and the elevator car;

at least one shaft door to at least one of open and close access to the at least one of the elevator shaft and the elevator car;

a position determination apparatus for determining a position of the elevator car inside the elevator shaft comprising a marking unit for marking the position of the elevator car, and a detection unit for at least one of detecting and reading the marking unit, wherein the position determination apparatus is arranged with one of the marking unit arranged on one of the shaft doors and the detection unit arranged on the associated car door, and the marking unit arranged on one of the car doors and the detection unit is arranged on the associated shaft door; and a control unit for controlling at least movement of the elevator car in the elevator shaft, wherein when the elevator car is moving in the elevator shaft the position determination apparatus sends the determined position of the elevator car in the elevator shaft to the control unit, and the control unit stops the elevator car at a predetermined position corresponding to a region of the at least one shaft opening based on the determined position from the position determination apparatus such that the at least one car door and the at least one shaft door associated with the at least one car door overlap each other when the elevator car is stopped at the predetermined position to provide access to the elevator car, wherein at least one of the associated shaft door and the car door has at least one of a recess and an indentation on their mutually facing sides, which uncovers an intermediate space between the shaft door and the associated car door, and wherein at least one of the marking unit and the detection unit is arranged in the intermediate space formed by at least one of the recess and the indentation.

2. The elevator apparatus according to claim 1, wherein the detection unit and the marking unit are arranged on mutually facing sides of the car door and the associated shaft door, respectively.

3. The elevator apparatus according to claim 1, wherein the marking unit is in the form of adhesive tape.

4. The elevator apparatus according to claim 1, wherein the marking unit is in the form of a carrier of a 2D code.

5. The elevator apparatus according to claim 1, wherein the detection unit is in the form of an optical sensor for at least one of detecting and reading the marking unit.

6. The elevator apparatus according to claim 1, wherein the detection unit further comprises a second optical sensor for detecting the at least one of people and items in the region of the at least one shaft opening.

7. The elevator apparatus according to claim 6, wherein the second optical sensor for detecting the at least one of people and items is in the form of a light barrier sensor for at least one of emitting and receiving light barrier signals.

8. The elevator apparatus according to claim 1, further comprising at least one of a reflection unit for reflecting light barrier signals and a light barrier detector for receiving light barrier signals.

9. The elevator apparatus according to claim 8, wherein at least one of the reflection unit and the light barrier detector is arranged on at least one of the elevator car, the car door and the shaft door.

10. The elevator apparatus according to claim 6, wherein the second optical sensor for detecting the at least one of people and items is in the form of a time-of-flight sensor.

11. A position determination apparatus for determining the position of an elevator car inside the elevator shaft for an elevator apparatus according to claim 1.

12. An elevator door comprising at least one of a marking unit and a detection unit of a position determination apparatus according to claim 11.

13. A building comprising an elevator apparatus according to claim 1.

14. The elevator apparatus according to claim 9, wherein at least one of the reflection unit and the light barrier detector is arranged on at least one of the elevator car and the car door in the intermediate space formed by the at least one of the recess and the indentation.

15. The elevator apparatus according to claim 9, wherein at least one of the reflection unit and the light barrier detector is arranged on the shaft door in the intermediate space formed by the at least one of the recess and the indentation.

16. The elevator apparatus according to claim 7, wherein the light barrier signals are transmitted into a gap between the at least one car door and the at least one shaft door associated with the at least one car door in a direction parallel to a direction of movement of the at least one car door and the at least one shaft door, and when the light barrier signals are interrupted a signal is sent to the control light unit and the control unit stops a closing movement of the at least one car door and the at least one shaft door.

17. The elevator apparatus according to claim 10, wherein an emitted signal comprises a carrier optical signal with a low frequency signal modulated thereon.

18. The elevator apparatus according to claim 17, wherein a phase shift of the low frequency signal modulated on the optical signal is used to determine a propagation time of the reflected optical signal.

19. The elevator apparatus according to claim 16, wherein the light barrier signals are transmitted at predetermined intervals to form a grid in a region around the at least one shaft door.

20. The elevator apparatus according to claim 1, wherein when the at least one car door is two or more car doors, the control unit controls the speed of travel of each of the car doors to reach an end position substantially at the same time.

* * * * *